US009395139B2

(12) United States Patent
Pena

(10) Patent No.: US 9,395,139 B2
(45) Date of Patent: Jul. 19, 2016

(54) RIFLE SLING SHOT DEVICE

(71) Applicant: Oscar Pena, Laredo, TX (US)

(72) Inventor: Oscar Pena, Laredo, TX (US)

( * ) Notice: Subject to any disclaimer, the term of this patent is extended or adjusted under 35 U.S.C. 154(b) by 0 days.

(21) Appl. No.: 14/557,517

(22) Filed: Dec. 2, 2014

(65) Prior Publication Data

US 2016/0153737 A1 Jun. 2, 2016

(51) Int. Cl.
*F41B 3/00* (2006.01)
*F41B 7/00* (2006.01)
*F41B 3/02* (2006.01)

(52) U.S. Cl.
CPC . *F41B 3/005* (2013.01); *F41B 3/02* (2013.01); *F41B 7/003* (2013.01)

(58) Field of Classification Search
CPC ..... F41B 3/005; F41B 3/02; F41B 7/003
USPC ..... 124/16, 17, 20.1, 20.3, 22, 31, 35.1
See application file for complete search history.

(56) References Cited

U.S. PATENT DOCUMENTS 440,538 A * 11/1890 Bruton ..... F41B 3/02 124/20.1
1,832,340 A * 11/1931 Williams ..... F41B 3/005 124/17
1,877,215 A * 9/1932 Albisu ..... F41B 3/005 124/22
2,501,568 A * 3/1950 Jarnagin ..... F41B 3/005 124/16
D159,082 S 6/1950 Trell
2,638,885 A * 5/1953 Keadle ..... F41B 3/005 124/20.1
2,708,924 A * 5/1955 Hurlburt ..... F41B 3/02 124/17
2,762,358 A * 9/1956 Kinnaman ..... F41B 7/04 124/22
2,786,461 A * 3/1957 Pelsue, Jr. ..... F41B 5/12 124/25
3,509,863 A * 5/1970 Barker ..... F41B 7/003 124/16
3,517,657 A * 6/1970 Alban ..... F41B 3/02 124/20.3
3,572,311 A * 3/1971 Baer ..... F41B 3/02 124/20.1
3,857,379 A * 12/1974 Burghardt ..... F41B 7/04 124/20.1
3,949,729 A * 4/1976 Pfotenhauer ..... F41B 5/12 124/20.1
4,050,438 A * 9/1977 Pfotenhauer ..... F41B 3/02 124/20.1
4,256,077 A 3/1981 Munson
4,278,065 A * 7/1981 Wales ..... F41B 3/005 124/20.1
4,386,598 A * 6/1983 Blaser ..... F41B 3/005 124/21
4,593,673 A * 6/1986 Kees ..... F41B 3/005 124/20.3
4,722,318 A * 2/1988 Yankey ..... F41B 5/143 124/25
4,784,106 A * 11/1988 Kees ..... F41B 3/005 124/16
4,860,719 A * 8/1989 Scheiterlein ..... F41B 5/143 124/25

(Continued)

*Primary Examiner* — Alexander Niconovich

(57) ABSTRACT

A rifle sling shot device facilitates aiming and shooting a projectile using a sling mechanism released by manipulating a trigger. The device includes a stock having a front end and a butt end. A pair of spaced arms is coupled to and extends upwardly from the stock proximate the front end of the stock. A trigger is coupled to the stock. A pin is coupled to the stock. The pin is moved by manipulation of the trigger. A band has opposed ends coupled to the arms. A length of the band is resiliently stretchable wherein the band is extendable into a stretched position. The band is released from the stretched position by manipulation of the trigger.

11 Claims, 4 Drawing Sheets

(56) References Cited

U.S. PATENT DOCUMENTS 4,895,128 A * 1/1990 Okada ..... F41B 7/04 124/22
5,243,955 A * 9/1993 Farless ..... F41B 3/005 124/20.1
5,431,145 A * 7/1995 Strait ..... A63B 65/122 124/17
5,524,603 A * 6/1996 Menzer ..... F41B 7/04 124/20.3
5,551,412 A * 9/1996 Warnke ..... F41B 3/005 124/20.1
5,642,723 A * 7/1997 Hogan ..... F41B 7/003 124/20.3
6,564,787 B1 * 5/2003 Barry ..... F41G 1/35 124/20.1
6,823,855 B2 * 11/2004 Omi ..... F41B 3/02 124/20.1
7,107,979 B2 * 9/2006 Mitchell ..... F41B 1/00 124/20.1
7,168,424 B1 * 1/2007 Wing ..... F41B 3/02 124/20.1
7,389,774 B1 * 6/2008 Fonda ..... F41B 3/02 124/20.1
7,392,801 B2 * 7/2008 McCallister ..... A63B 21/0552 124/17
7,464,701 B1 12/2008 Mendoza et al.
7,509,952 B2 * 3/2009 Aiken, III ..... F41B 3/02 124/20.1
7,900,620 B1 * 3/2011 Walters ..... F41B 3/02 124/20.1
8,695,576 B2 * 4/2014 Zadra ..... F41B 3/02 124/20.1
2014/0069401 A1 * 3/2014 McPherson ..... F41B 5/12 124/25
2014/0069404 A1 * 3/2014 McPherson ..... F41B 5/123 124/25
2015/0136102 A1 * 5/2015 Ricke ..... F41B 3/02 124/17

* cited by examiner

RIFLE SLING SHOT DEVICE

BACKGROUND OF THE DISCLOSURE

Field of the Disclosure

The disclosure relates to sling shot devices and more particularly pertains to a new sling shot device for facilitating aiming and shooting a projectile using a sling mechanism released by manipulating a trigger.

SUMMARY OF THE DISCLOSURE

An embodiment of the disclosure meets the needs presented above by generally comprising a stock having a front end and a butt end. A pair of spaced arms is coupled to and extends upwardly from the stock proximate the front end of the stock. A trigger is coupled to the stock. A pin is coupled to the stock. The pin is moved by manipulation of the trigger. A band has opposed ends coupled to the arms. A length of the band is resiliently stretchable wherein the band is extendable into a stretched position. The band is released from the stretched position by manipulation of the trigger.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
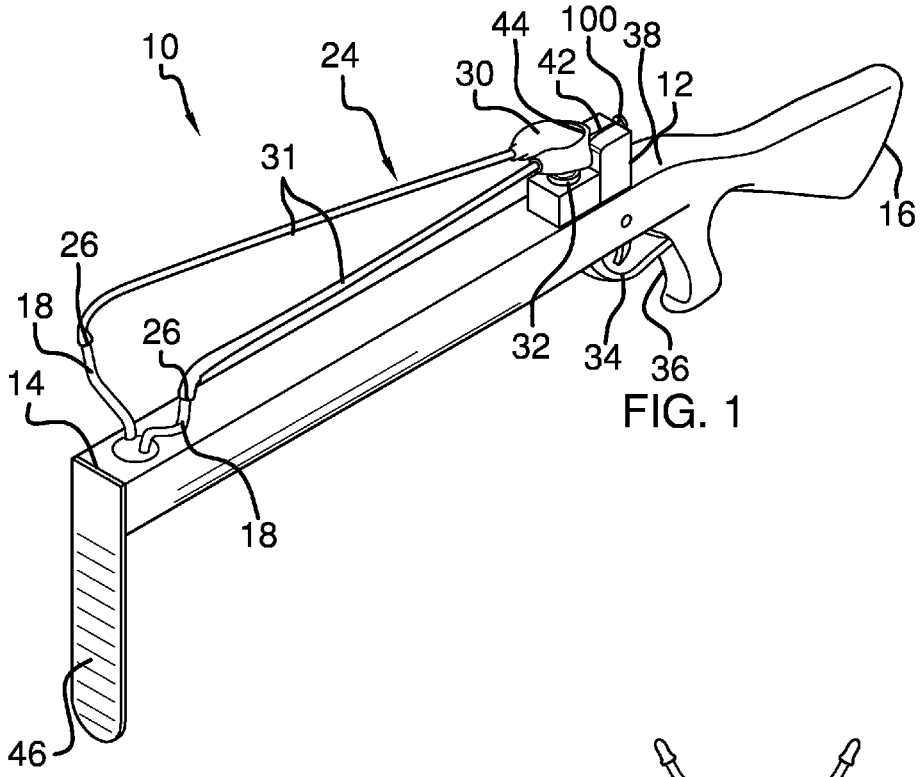
FIG. 1 is a top front side perspective view of a rifle sling shot device according to an embodiment of the disclosure.
Figure 2:
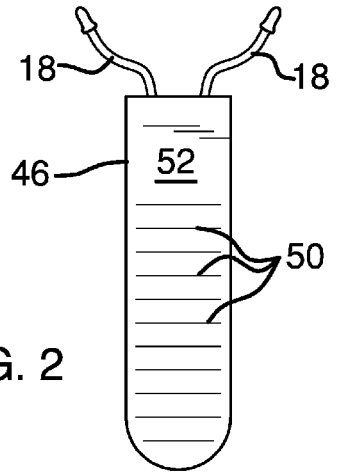
FIG. 2 is a front view of an embodiment of the disclosure.
Figure 3:
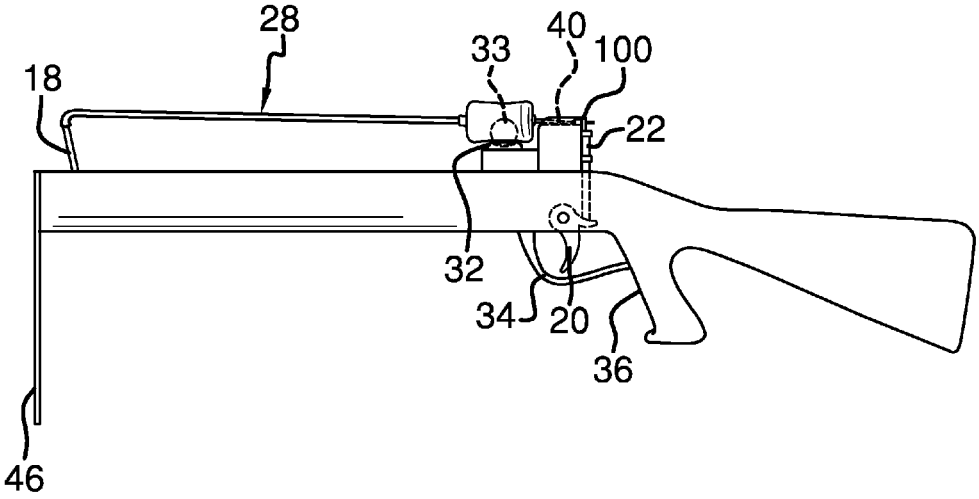
FIG. 3 is a side view of an embodiment of the disclosure.
Figure 4:
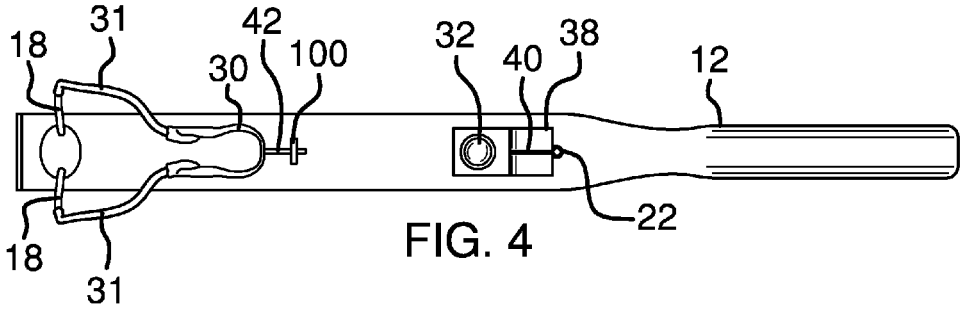
FIG. 4 is a top view of an embodiment of the disclosure.
Figure 5:
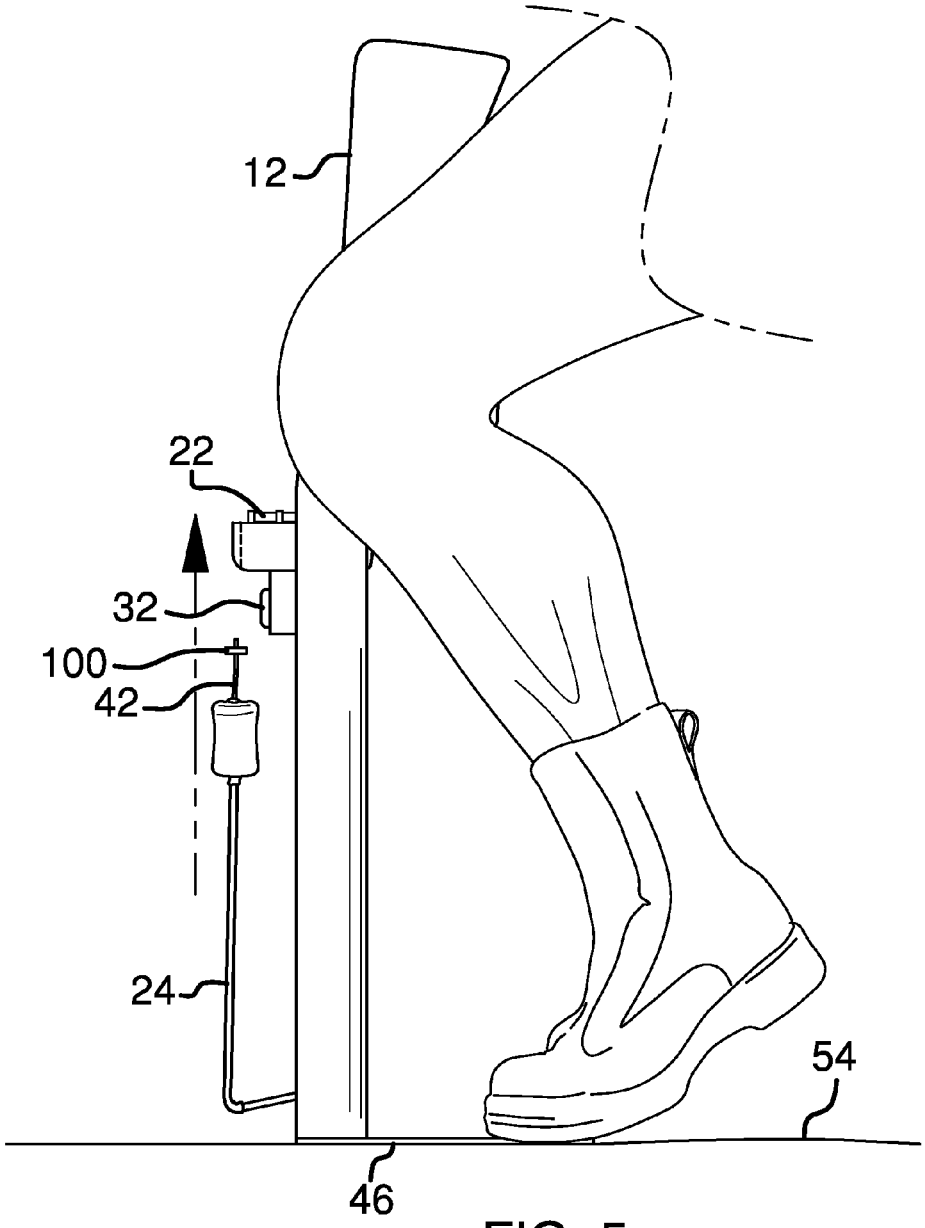
FIG. 5 is a side view of an embodiment of the disclosure in use.
Figure 6:
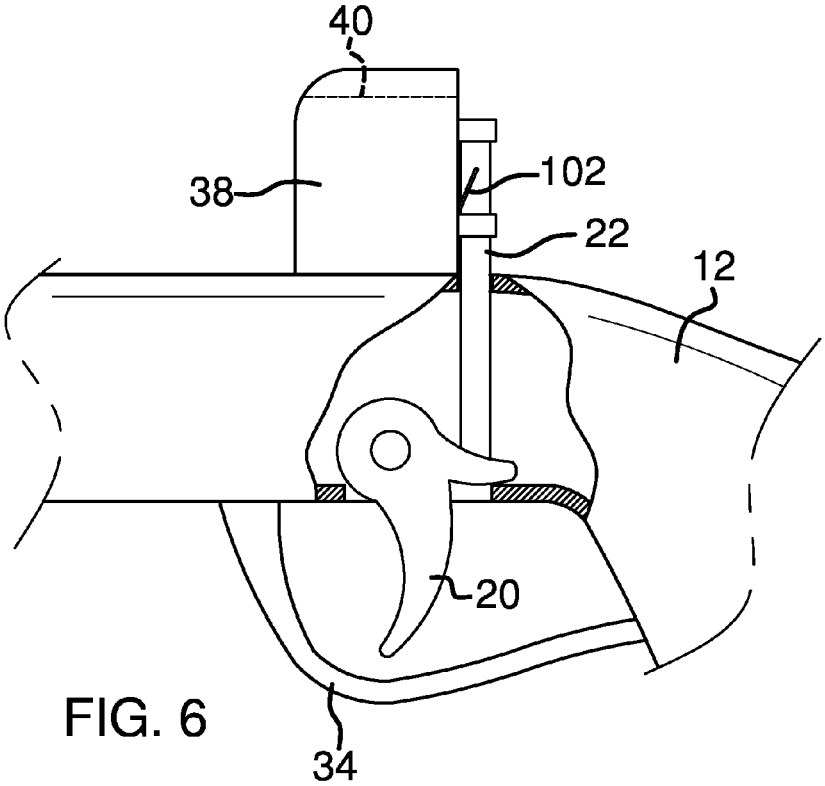
FIG. 6 is a partial cut-away side view of an embodiment of the disclosure.
Figure 7:
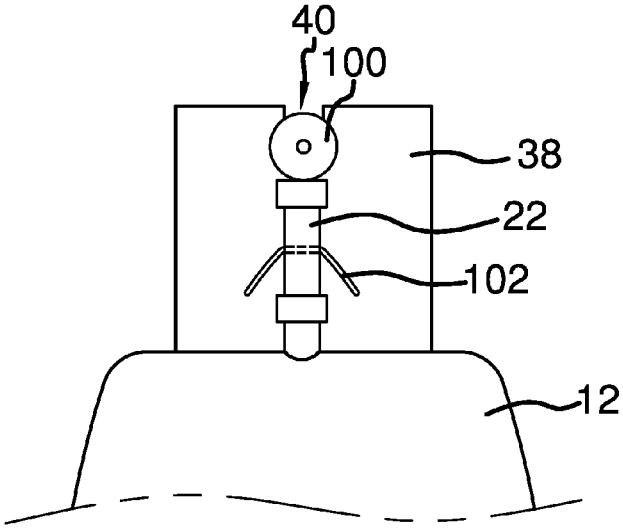
FIG. 7 is a detailed partial rear view of an embodiment of the disclosure.

With reference now to the drawings, and in particular to FIGS. 1 through 7 thereof, a new sling shot device embodying the principles and concepts of an embodiment of the disclosure and generally designated by the reference numeral 10 will be described.

As best illustrated in FIGS. 1 through 7, the rifle sling shot device 10 generally comprises a stock 12 having a front end 14 and a butt end 16. The stock 12 may be constructed from wood or like material. A distance between the front end 14 and the butt end 16 may be between approximately 110.0 cm and 140.0 cm. A pair of spaced arms 18 is coupled to and extends upwardly from the stock 12 proximate the front end 14 of the stock 12. A trigger 20 is coupled to the stock 12. A pin 22 is coupled to the stock 12. The pin 22 is moved by manipulation of the trigger 20. A biasing member 102 urges the pin 22 downwardly into abutment with the trigger 20. The biasing member 102 may be a resilient strip, rubber band, or the like.

A band 24 has opposed ends 26 coupled to the arms 18. The band 24 comprises a pocket 30 and a pair of resiliently stretchable side sections 31 coupled to and extending from the pocket 30. The pocket 30 is a flexible panel constructed of non-resilient material, such as leather or the like. The pocket 30 may be centrally positioned between the opposed ends 26 of the band 24.

A block 38 is coupled to and extends upwardly from the stock 12. The pin 22 is slidably coupled to the block 38. A slot 40 extends through the block 38. A loop 42 is coupled to and extends from a center 44 of the pocket 30. A length of the band 24 is resiliently stretchable wherein the band 24 is extendable into a stretched position 28. The loop 42 is positionable extending through the slot 40 when the band 24 is in the stretched position 28. The loop 42 is coupled to a washer 100 which prevents the loop 42 from passing back through the slot 40. Manipulation of the trigger 30 urges the pin 22 upwards to disengage the washer 100 from the block 38 and releasing the band 24 from the stretched position. The slot 40 is aligned with a longitudinal axis of the stock 12 wherein positioning of the loop 42 to extend through the slot 40 when the loop 42 engages the pin 22 equalizes tension in the side sections 31 of the band 24 extending from the pocket 30.

A seat 32 is coupled to the stock 12. The seat 32 is configured for holding a projectile 33 adjacent to the pocket 30 while the band 24 is in the stretched position 28 wherein the pocket 30 engages and propels the projectile 33 upon release of the washer 100 from the block 38 upon manipulation of the trigger 20. The projectiles 33 may include marbles, paint balls or the like. The seat 32 may be magnetic. A trigger guard 34 is coupled to and extends from the stock 12. The trigger guard 34 extends around the trigger 20 wherein the trigger guard 34 is configured for preventing inadvertent manipulation of the trigger 20. A grip 36 is coupled to and extends downwardly from the stock 12. The grip 36 is positioned adjacent to the trigger 20 wherein the trigger 20 is configured for being manipulated by a finger of a hand grasping the grip 36.

A plate 46 is coupled to and extends transversely from the front end 14 of the stock 12. A plurality of ridges 50 is coupled to and extends transversely across an outer face 52 of the plate 46 relative to the seat 32 wherein the plate 46 is configured for resisting slipping on a surface 54 when the plate 46 is positioned between the surface 54 and a foot to facilitate stretching of the band 24 into the stretched position 28 to engage the band 24 in the stretched position by positioning the loop 42 extending through the slot 40. The plate 46 may be constructed from steel or like material.

In use, as stated above and shown in the Figures, the band 24 is extended into the stretched position 28 such that the band engages the pin 22. The loop 42 is positioned to extend through the slot 40 such that the loop 42 engages the pin 22. The projectile 33 is positioned in the seat 32. The plate 46 is positioned between a surface 54 and is stepped on by a foot to facilitate stretching the band 24 into the stretched position 28. The trigger 20 is then manipulated to release the band 24 from the pin 22 to propel the projectile 33 outwardly of the seat 32.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A rifle sling shot device comprising:

a stock having a front end and a butt end;

a pair of spaced arms coupled to and extending upwardly from said stock proximate said front end of said stock;

a trigger coupled to said stock;

a pin coupled to said stock, said pin being moved by manipulation of said trigger, said pin being slidably coupled to a block extending upwardly from said stock;

a band having opposed ends coupled to said arms, a length of said band being resiliently stretchable wherein said band is extendable into a stretched position, said band being released from said stretched position by manipulation of said trigger, said band comprising a pocket and a pair of resiliently stretchable side sections coupled to and extending from said pocket;

a seat coupled to said stock, said seat being configured for holding a projectile adjacent to said pocket while said band is in said stretched position wherein said pocket engages and propels the projectile upon manipulation of said trigger, said block being adjacent to said seat;

a slot extending through said block;

a loop coupled to and extending from a center of said pocket, said loop being positionable extending through said slot when said band is in said stretched position; and a washer coupled to said loop, said washer being engageable to said block such that said band is retained in said stretched position and said washer is positioned over said pin such that upward movement of said pin when said trigger is squeezed urges said washer upwardly to disengage said washer from said block and free said loop from said slot.

2. The device of claim 1, further comprising said pocket being a flexible panel of non-resilient material.

3. The device of claim 1, further comprising said pocket being centrally positioned between said opposed ends of said band.

4. The device of claim 1, further comprising said seat being magnetic.

5. The device of claim 1, further comprising a trigger guard coupled to and extending from said stock, said trigger guard extending around said trigger wherein said trigger guard is configured for preventing inadvertent manipulation of said trigger.

6. The device of claim 1, further comprising said slot being aligned with a longitudinal axis of said stock wherein positioning of said loop to extend through said slot when said loop engages said pin equalizes tension in said side sections of said band extending from said pocket.

7. The device of claim 1, further comprising a grip coupled to and extending downwardly from said stock.

8. The device of claim 7, further comprising said grip being positioned adjacent to said trigger wherein said trigger is configured for being manipulated by a finger of a hand grasping said grip.

9. The device of claim 1, further comprising a plate coupled to and extending transversely from said front end of said stock.

10. The device of claim 9, further comprising a plurality of ridges coupled to and extending transversely across an outer face of said plate relative to said seat wherein said plate is configured for resisting slipping on a surface when said plate is positioned between the surface and a foot to facilitate stretching of said band into said stretched position to engage said band to said pin.

11. A rifle sling shot device comprising:

a stock having a front end and a butt end;

a pair of spaced arms coupled to and extending upwardly from said stock proximate said front end of said stock;

a trigger coupled to said stock;

a pin coupled to said stock, said pin being moved by manipulation of said trigger;

a band having opposed ends coupled to said arms, a length of said band being resiliently stretchable wherein said band is extendable into a stretched position, said band comprising a pocket and a pair of resiliently stretchable side sections coupled to and extending from said pocket, said pocket being a flexible panel of non-resilient material, said pocket being centrally positioned between said opposed ends of said band;

a seat coupled to said stock, said seat being configured for holding a projectile adjacent to said pocket while said band is in said stretched position wherein said pocket engages and propels the projectile upon release of said band by manipulation of said trigger, said seat being magnetic;

a trigger guard coupled to and extending from said stock, said trigger guard extending around said trigger wherein said trigger guard is configured for preventing inadvertent manipulation of said trigger;

a block coupled to and extending upwardly from said stock, said pin being slidably coupled to said block;

a slot extending through said block;

a loop coupled to and extending from a center of said pocket, said loop being positionable extending through said slot when said band is in said stretched position;

a washer coupled to said loop, said washer being engageable to said block such that said band is retained in said stretched position and said washer is positioned over said pin when said washer is engaged to said block such that upward movement of said pin when said trigger is squeezed urges said washer upwardly to disengage said washer from said block and free said loop from said slot, said slot being aligned with a longitudinal axis of said stock wherein positioning of said loop to extend through said slot when said washer engages said block equalizes tension in said side sections of said band extending from said pocket;

a grip coupled to and extending downwardly from said stock, said grip being positioned adjacent to said trigger wherein said trigger is configured for being manipulated by a finger of a hand grasping said grip;

a plate coupled to and extending transversely from said front end of said stock; and a plurality of ridges coupled to and extending transversely across an outer face of said plate relative to said seat wherein said plate is configured for resisting slipping on a surface when said plate is positioned between the surface and a foot to facilitate stretching of said band into said stretched position to engage said band to said pin.

* * * * *